United States Patent [19]

Spickermann

[11] Patent Number: 4,660,481

[45] Date of Patent: Apr. 28, 1987

[54] SEWING MACHINE HAVING PRESSER FOOT PRESSURE FORCE MEASURING DEVICE

[75] Inventor: Rainer Spickermann, Thaleischweiler, Fed. Rep. of Germany

[73] Assignee: Pfaff Industriemaschinen GmbH, Fed. Rep. of Germany

[21] Appl. No.: 860,056

[22] Filed: May 6, 1986

[30] Foreign Application Priority Data

May 7, 1985 [DE] Fed. Rep. of Germany ..... 3516366

[51] Int. Cl.[4] ..... D05B 29/00

[52] U.S. Cl. ..... 112/235; 73/862.54

[58] Field of Search ..... 112/235, 237, 121.11, 112/453, 254, 270; 73/862.55, 862.54, 862.65, 862.01

[56] References Cited

U.S. PATENT DOCUMENTS

| | | | |
|---|---|---|---|
| 3,055,326 | 9/1962 | Greulich | 112/235 |
| 3,554,025 | 1/1971 | Andersson et al. | 73/862.55 X |
| 4,166,423 | 9/1979 | Brienza et al. | 112/254 |
| 4,289,036 | 9/1981 | Barker | 73/862.65 X |
| 4,478,092 | 10/1984 | Oren, III | 73/862.55 |
| 4,565,143 | 1/1986 | Hanyu et al. | 112/272 X |

*Primary Examiner*—Peter Nerbun

*Attorney, Agent, or Firm*—McGlew and Tuttle

[57] ABSTRACT

A sewing machine having a reciprocating needle bar and a presser foor which is movable upwardly and downwardly to engage material and move it over a sewing station includes a presser foot measuring device. A system for measuring the pressing force of the presser foot of sewing machines comprises a lever type force absorption element which is elastically deformable by the pressing force of the presser foot and which is provided with an electric sensor responding to the deformation. Connected with the sensor is a circuit which contains a digital display on which the pressing force is indicated in newtons.

3 Claims, 3 Drawing Figures

1
2
3
4
5
6
7
8
9
10
11
12
13
14
15
16
17
18
19
21
22
23
24
26
27
28
29

SEWING MACHINE HAVING PRESSER FOOT PRESSURE FORCE MEASURING DEVICE

FIELD AND BACKGROUND OF THE INVENTION

This invention relates in general to sewing machines and in particular to a new and useful sewing machine having a device for measuring the pressure exerted by a presser for calibrating the pressure with a reference source.

For some sewing jobs, the normal value of the pressing force of the presser foot cooperating with the sewing machine feed, as adjusted when the sewing machine was assembled, is inappropriate. Thin and pressure sensitive fabrics, for example, require a reduced pressing force, while thick fabrics as well as firm material or fabrics with a smooth surface require a comparatively higher pressing force. For material difficult to work, therefore, it would be advantageous if the pressing force of the presser foot would be adjustable to empirically established values which take into consideration the influences of different parameters such as work thickness, number of plies, type of fabric, and sewing speed.

In view of U.S. Pat. No. 3,055,326 a sewing machine with an adjustable presser system is known in which a setting wheel with control cam means presents several display symbols, e.g. numbers, which appear one by one in a window. While by means of the display symbols the pressing force of the presser foot can be adjusted stepwise, the pressing force, which becomes active at the individual display symbols at the presser foot, depends on the respective spring constants of the spring mechanism and on the friction conditions of the entire presser system. Since thus the pressing forces actually occurring at the same display symbols may differ from machine to machine, set values which take into consideration different parameters determined by tests cannot be transformed with the aid of setting wheels carrying display symbols with the necessary accuracy into corresponding pressing forces of the presser foot even when the set values are indicated in the form of the same symbols as used on the setting wheels.

SUMMARY OF THE INVENTION

The invention provides a system for measuring the pressing force of presser feet which makes it possible to adjust given set values for the pressing force exactly in presser systems.

With the measuring system calibratable by comparison a reference force, the indication of which is laid out, e.g. in newtons as a unit of force, set values expressed in newtons can be transmitted to the respective sewing machine very accurately. If the measuring system is not connected with the sewing machine but is a separate instrument, it is possible with a single intrument to adjust the desired pressing force of the presser foot on any number of machines and especially also on machines of a different model.

A variant of the system is a separate instrument where the force absorption element is designed as a lever, one end of which can be placed under the presser foot to perform the measuring process. So that the measuring process can be carried out under conditions as they occur in practice, the thickness of this lever end is chosen so that it corresponds essentially to the average thickness of the material to be worked.

According to an especially simple design, the lever takes support on the work carrying surface by means of a cross rib, the cross rib and work carrying surfce forming a simplified form of a low-friction knife edge bearing. The swivel motion of the lever occurs under the influence of the counter-force to be provided manually. Therefore, the work carrying surface serves the sewing machine as an abutment and for this no separate part is needed. Therefore, the measuring system comrpises a single mechanical part, which also serves as a support for the electric sensor formed by strain gauges.

Accordingly it is an object of the invention to provide a sewing machine which has a presser foot which is movable upwardly and downwardly over a sewing station, and which includes means for measuring the pressure exerted by the presser foot and for calibrating it with a referenced pressure.

A further object of the invention is to provide a sewing machine having a presser foot pressure measurng device, which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figures 1, 2:
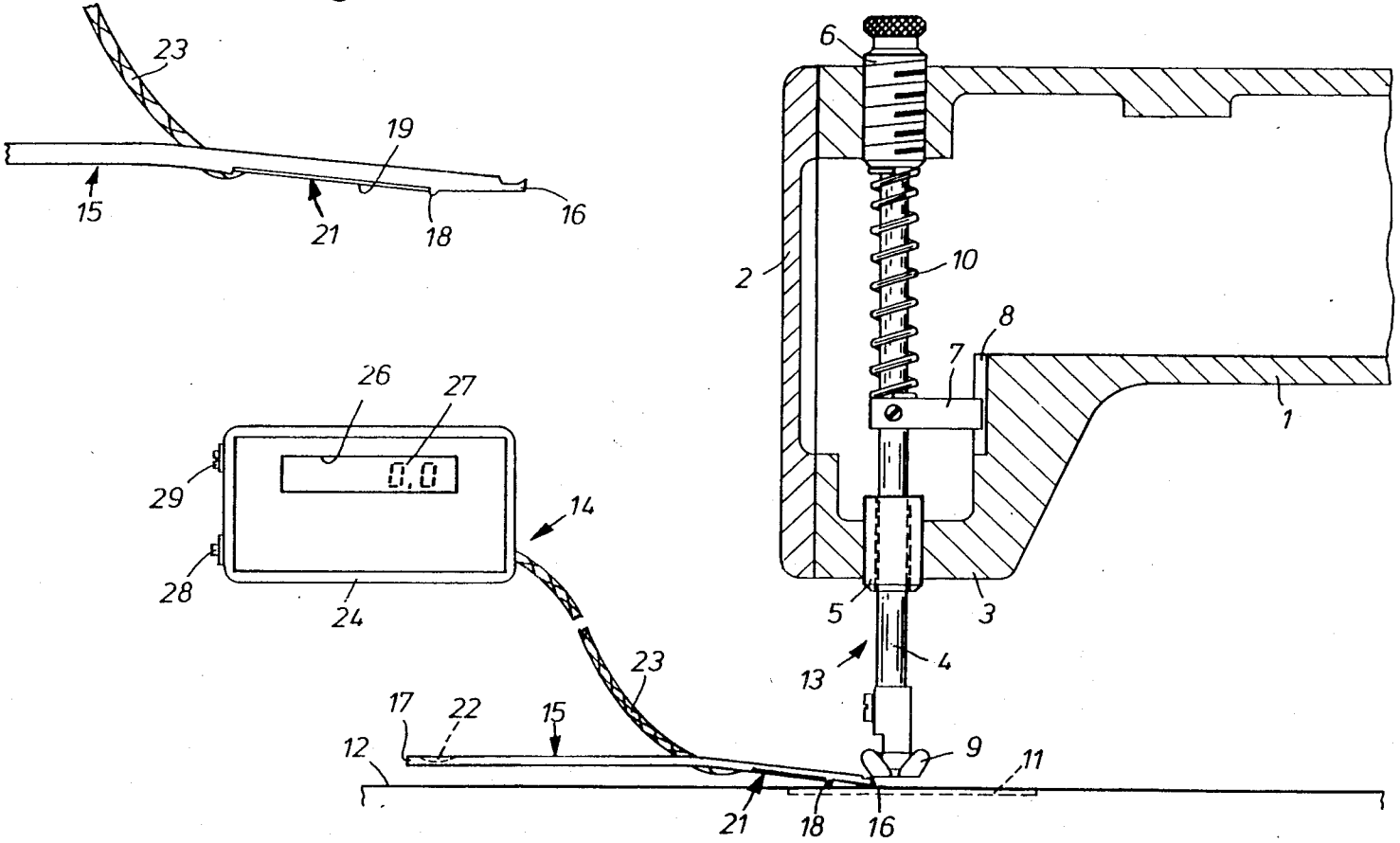
FIG. 1 is a sectional view of the measuring system and of the presser system of a sewing machine with one lever end being arranged under the presser foot.
FIG. 2 is an elevational enlarged view of the lever end equipped with a sensor.
Figure 3:
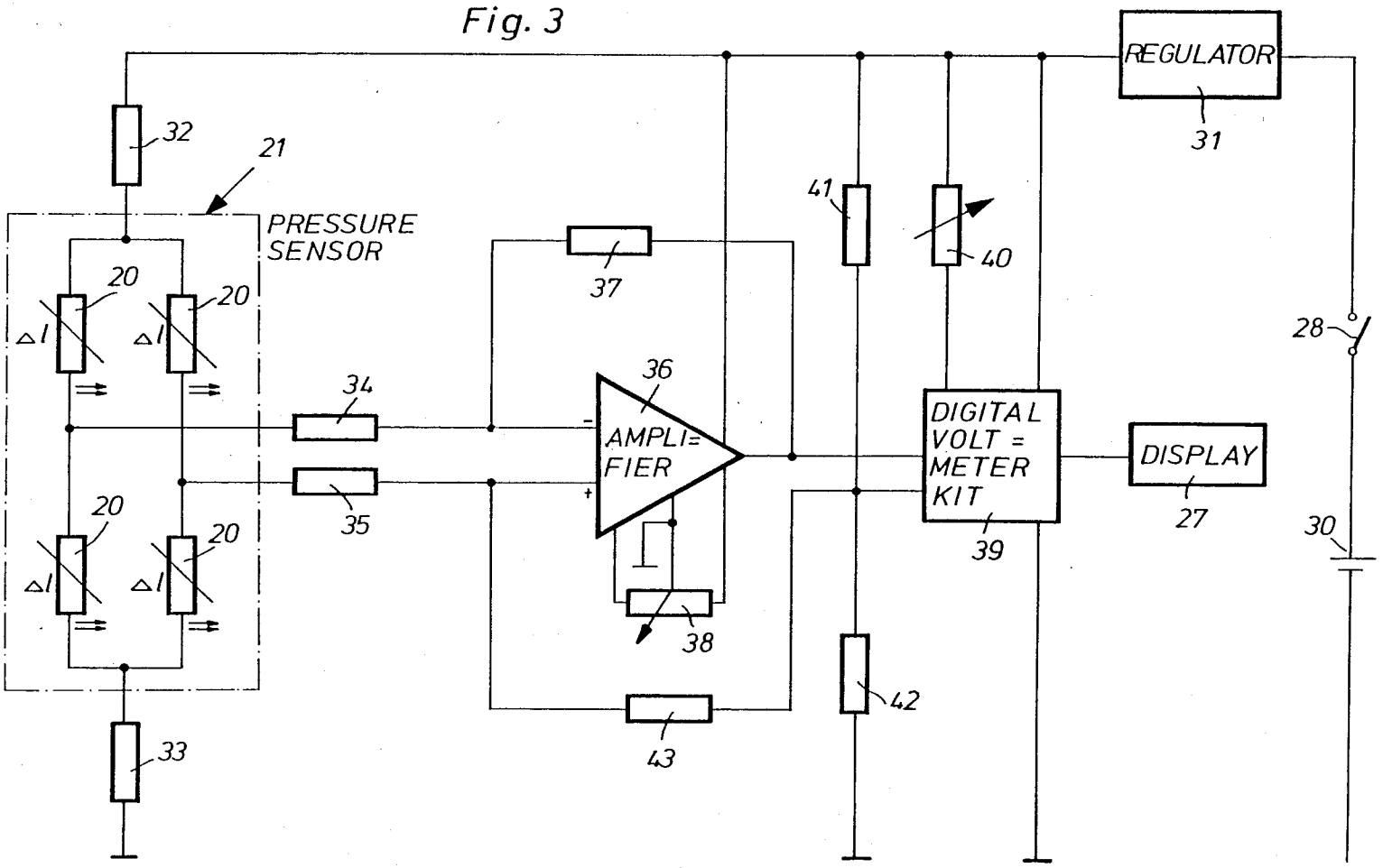
FIG. 3 is a simplified wiring plan of the circuit of the measuring system.

Referring to the drawings in particular the invention embodied therein comprises a sewing machine with a presser bar 4 which moves upwardly and downwardly and carries a presser foot 9 and which includes a device for measuring the presser exerted by the presser for indicating this pressure in a display and for also calibrating the pressure with a reference force.

The sewing machine, shown in part in FIG. 1, contains a housing arm 1, whih terminates in a head 3 closed by a cover 2. Arranged in the head 3 is a presser bar 4, which is displaceably mounted in a fixed bushing 5 and a screw bushing 6 provided with an external thread and which is therefore adjustable. A guide element 7, clamped on the presser bar 4, engages by its one end into a vertical guide groove 8, whereby the presser bar 4 is secured against rotation. On the presser bar 4 a presser foot 9 is disposed. Secured onto he presser bar 4 is a compression spring 10, braced at one end against the screw bushing 6 and at the other end against the guide element 7. In its operating position the presser foot 9 is pushed downward by the compression spring 10 and takes support on a stitch plate 11 of the sewing machine which is a component part of a work carrying surface 12 of the base plate or a table of the sewing machine.

The pressing force of the presser foot 9 can be adjusted by turning the screw bushing 6. Components 4 to 10 form a presser system 13.

The system 14 for measuring the pressing force of presser foot 9 comprises a lever 15 serving as force absorption element; its two ends are marked 16 and 17. In the region of the end 16, the lever 15 has a height or thickness of 1.7 mm. On the underside of lever 15, at a small distance from the end 16, a cross rib 18 is formed, and contiguous thereto a flat recess 19 is provided, into which an active full bridge consisting of four strain gauges 20 as an electric sensor is glued. On the top side, in the region of its end 17, lever 15 has a shallow depression 22.

Through a bore (not shown) in lever 15 a cable 23 is passed which connects the sensor 21 with a circuit lodged in a housing 24. Housing 24 has a window 26 for a liquid crystal display. Further an on-off switch 28 and a set screw 29 are provided at housing 24.

A voltage taken off at a battery 30 and stabilized through a regulator 31 is applied at the four strain gauges 20. Two resistors 32, 33 bring about a reduced current consumption. The voltage taken off at the sensor 21 is supplied via two resistors 34, 35 to two inputs of an operational amplifier 36 which is in feedback via a resistor 37. Zero point adjustment on display 27 can be carried out via a potentiometer 38. Potentiometer 38 is connected with the setting screw 29, so that the zero point adjustment can be accomplished from the outside at any time.

The output of the operational amplifier 36 is connected to a digital voltmeter kit 39 constructed as an integrated circuit, e.g. the ICL 7106 of Intersil. To the voltmeter kit 39 the LCD display 27 is connected. A potentiometer 40 contained in housing 24, which acts as amplification control and serves to calibrate the measuring system 14, is associated with the voltmeter kit 39.

A voltage divider composed of two resistors 41,42 serves to create an artificial zero point at one input of the voltmeter kit 39, in order that, with no load applied on lever 15, a differential voltage of 0 volts occurs at the inputs of the voltmeter kit 39 despite the use of only one voltage source (battery 30). A feedback via a resistor 43, of the input of kit 39 forming the artificial zero to the non-inverting input of the operational amplifier 36 serves the same purpose.

For the performance of a measuring process, the end 16 of lever 15 is placed on stitch plate 11 under the lifted presser foot 9, which is then lowered. The presser foot 9 then pivots lever 15 about the cross rib 18 into the position shown in FIG. 1 and presses the end 16 against the stitch plate 11. Since at this time no load has been applied on lever 15 as yet, the value 0.0 must appear on display 27 after the closing of switch 26. If this is not the case, a zero point adjustment is made via the setting screw 29 and the potentiometer 38 connected therewith.

Thereafter lever 15 is pivoted by hand until its end 17 rests on the work carrying surface 12. In so doing, its end 16 and hence also the presser foot 9 are raised 0.2 mm counter to the force of compression spring 10. The raising of presser foot 9 causes a slight elastic deformation to occur in lever 15. Thereby a change of resistance is brought about in known manner in the strain gauges 20 lying in the direction of load application, whereby the previously balanced bridge is unbalanced. The then occurring voltage is amplified by the operational amplifier 36 and supplied to the voltmeter kit 39. The latter generates corresponding control signals for the LCD display 27. By comparison with a reference force, the measuring system is calibrated with the aid of potentiometer 40 in such a way that the numerical value of display 27 indicates in newton units the pressing force active at the presser foot 9. During the measuring process, by turning the screw bushing 6, the desired pressing force of the presser foot 9 can be adjusted and the respective value of the pressing force can immediately be read on the display 27.

Due to the raising of the presser foot 9 by 0.2 mm, the presser foot 9 will be $1.7+0.2=1.9$ mm above the stitch plate 11 during the measuring process. As this corresponds to the average thickness of the material to be worked, the measuring process is carried out under conditions as they occur in the practice.

While a specific embodiment of the invention has been shown and described in detail to illustrate the application of the principles of the invention, it will be understood that the invention may be embodied otherwise without departing from such principles.

What is claimed is:

1. In a sewing machine having a presser foot which is reciprocated upwardly and downwardly above a sewing station, over which materials are passed, the improvement comprising a force absorption element positioned between the presser foot and the sewing station, said force absorption element including an element movable in response to pressure thereon by the presser foot, and a sensor circuit connected to said movable element and responsive to movement thereof due to force applied by said presser foot to indicate the pressure force acting, said sensor circuit element including a lever having one end pivotally mounted on the sewing station at a location intermediate the length of said lever and having one end extending below the presser foot at a height substantially equal to the average thickness of the material to be worked and having an opposite end which is loadable with a counterforce.

2. In a sewing machine according to claim 1, wherein said sensor circuit includes means for calibrating the indicated force with a reference force.

3. In a sewing machine according to claim 1, wherein said lever has a cross rib on its underside resting on the sewing station and wherein the sewing station serves as an abutment for the opposite end of said lever member permitting this end to be pushed down by hand and wherein said sensor circuit includes a strain gauge attached to said lever.

* * * * *